US008388880B2

(12) United States Patent
Tuma

(10) Patent No.: US 8,388,880 B2
(45) Date of Patent: Mar. 5, 2013

(54) METHOD FOR THE PRODUCTION OF AN ADHESIVE CLOSURE DEVICE TOGETHER WITH APPARATUS AND ADHESIVE CLOSURE DEVICE PRODUCED ACCORDINGLY

(75) Inventor: Jan Tuma, Herrenberg (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 492 days.

(21) Appl. No.: 12/449,843

(22) PCT Filed: Jan. 29, 2008

(86) PCT No.: PCT/EP2008/000646

§ 371 (c)(1),
(2), (4) Date: Aug. 31, 2009

(87) PCT Pub. No.: WO2008/119407

PCT Pub. Date: Oct. 9, 2008

(65) Prior Publication Data

US 2010/0095489 A1 Apr. 22, 2010

(30) Foreign Application Priority Data

Mar. 30, 2007 (DE) ..... 10 2007 015 441

(51) Int. Cl.
*B29C 70/76* (2006.01)
*B29C 33/12* (2006.01)
*B29C 33/36* (2006.01)

(52) U.S. Cl. ..... 264/250; 264/275; 264/271.1; 24/442; 24/452; 428/99; 428/100

(58) Field of Classification Search ..... None
See application file for complete search history.

(56) References Cited

U.S. PATENT DOCUMENTS

| | | | | |
|---|---|---|---|---|
| 5,785,784 | A | 7/1998 | Chesley et al. | |
| 5,983,467 | A * | 11/1999 | Duffy | 24/442 |
| 6,180,205 | B1 | 1/2001 | Tachauer et al. | |
| 6,569,374 | B1 | 5/2003 | Poulakis | |
| 6,852,258 | B1 * | 2/2005 | Martin et al. | 264/46.4 |
| 2003/0126724 | A1 | 7/2003 | Kono et al. | |
| 2004/0134045 | A1 | 7/2004 | Poulakis et al. | |
| 2006/0220271 | A1 | 10/2006 | Jackson et al. | |

FOREIGN PATENT DOCUMENTS

| | | | |
|---|---|---|---|
| DE | 101 23 205 | A1 | 11/2002 |
| DE | 699 22 264 | T2 | 3/2006 |
| EP | 0 661 007 | A2 | 7/1995 |
| EP | 0 894 448 | A1 | 2/1999 |
| JP | 01-250201 | | 10/1989 |
| WO | WO 98/30381 | A1 | 7/1998 |
| WO | WO 01/24654 | A1 | 4/2001 |
| WO | WO 03/059109 | A1 | 7/2003 |
| WO | WO 2006/099000 | A2 | 9/2006 |

* cited by examiner

*Primary Examiner* — Jack W. Lavinder
(74) *Attorney, Agent, or Firm* — Roylance, Abrams, Berdo & Goodman, L.L.P.

(57) ABSTRACT

During a method for the production of a touch-and-close fastener (10), preferably of at least one plastic material, a backing (12) with a plurality of protruding stems (14) is connected to individual heads (16). For at least a part of the stems (14), their free ends (18) come into contiguous or embedded contact with a contact face (20) of each assignable head (16). The invention relates additionally to an apparatus for carrying out the method and to a fastener produced according to the method.

5 Claims, 2 Drawing Sheets

METHOD FOR THE PRODUCTION OF AN ADHESIVE CLOSURE DEVICE TOGETHER WITH APPARATUS AND ADHESIVE CLOSURE DEVICE PRODUCED ACCORDINGLY

FIELD OF THE INVENTION

The invention relates to a method for the production of an adhesive closure device or touch-and-close fastener, preferably of at least one plastic material. The invention relates furthermore to an apparatus for carrying out the method and an adhesive closure device produced according to the method and using the apparatus according to the invention.

BACKGROUND OF THE INVENTION

These touch fastener elements also include mechanical fastening elements, with touch fastener elements made in a complementary manner, form a fastener which can be repeatedly opened and closed. Hooks or mushroom-like fastener parts interacting with loop-like fastener elements of another touch fastener element with the formation of a touch or a touch-and-close fastener. Solutions are also known in which the same touch fastener elements of two different touch fastener elements interact with one another (hermaphroditic fastener).

DE 699 22 264 T2 discloses supplying a belt-like backing part with a plurality of projecting stem parts to a molding gap between heatable molding rolls. An extrusion means supplies an additional molding belt of plastic material into the gap as the actual molding tool with mold recesses shapes the hot stem ends of the stem parts into head parts to form a mushroom-like touch fastener element. Since the head parts in the known solution are formed from the plastic material of the stem parts, the head parts are of smaller dimension due to low material charging in the free and projecting head surface available for interlocking. This smaller dimension can adversely affect the required adhesion forces.

Conversely, U.S. Pat. No. 6,180,205 proposes a production method using a molding roll in which a belt-like backing part can be connected to a plurality of hook fastener elements dimensioned to be relatively large. For this purpose, the molding roll on its outer periphery has hook-shaped mold recesses into which plastic material is pressed to fill the mold a first extruder. Excess plastic material on the outer peripheral side of the molding roll is removed by cutting removal means, technically called a doctor blade. By a second extruder located downstream in the production direction, the backing part material is then applied and permanently connected to the hook-shaped fastener parts during the cooling process of the roll. A stripper roll then removes the finished fastener part from the molding means. Due to the hook geometry, difficulties can arise during the mold removal process. Furthermore, a relatively high proportion of plastic scrap is formed in the production process due to use of the doctor blade.

WO 2006/099000 A2 discloses spraying a belt-like conveyor device on its upper strand side with droplets of plastic material. The plastic material is molded based on its surface tension into hemispherical shell bodies which are then permanently connected on their arching top to a belt-like backing part, with the formation of a touch fastener element. In one development of this solution it is also possible, in the manner of thickened stem parts, to supply a belt-like backing part which on its top bears grain-shaped agglomerates as the stem parts onto which then the hemispherical head parts can be placed. The touch fastener element produced in this way and designed to be used in particular as a fastener for baby diapers or incontinence diapers is, however, made relatively stiff and leaves much to be desired with respect to the fastener characteristics. U.S. Patent Publication 2006/0220271 A1 discloses a comparable solution calling for a molding tool in the form of a molding roll with the corresponding mold recesses instead of a belt for production of hemispherical fastener elements. Production of stem parts between the head parts and backing part is not done with this known solution.

U.S. Pat. No. 5,785,784 discloses a production method for producing a belt-like backing part on which a plurality of projecting stem parts extend. In a downstream production step, the free stem ends are heated and then thicken as a result of the surface tension of the plastic material, in particular, into a hemispherical head part. If, in a continuation of the known solution, the head parts produced in this way are reshaped by a calander rolling method, widened head part geometries are formed which, with respect to the low material charge, are made relatively small and are widened only in the rolling direction.

SUMMARY OF THE INVENTION

An object of the invention is to provide an improved production system with low production costs making a reliable touch fastener adjustable in wide ranges in terms of its fastening behavior.

This object is basically achieved by a method, along with the apparatus and touch fastener element, to produce a touch fastener element, preferably of at least one plastic material, characterized in that a backing part with a plurality of projecting stem parts is connected to individual head parts such that at least for some of the indicated stem parts their free ends come into contiguous or embedded contact with the contact side of the respective head part. By subsequently placing separately produced head parts on the free end side of the respective stem parts, different material components of the stem parts can be combined with head parts in very wide ranges, and different geometries for head parts and/or stem parts can be defined. Based on the plurality of combination possibilities, a plurality of technical parameters can thus be set in a touch fastener element produced in this way. The method according to the invention is moreover reliable in application and can be economically implemented.

An apparatus proven to be especially economical for carrying out the method has for the individual head parts a molding tool with a plurality of mold recesses corresponding to the respective head geometry, and a supply device for the already finished or preformed backing part with the stem parts whose free ends can be inserted into the mold recesses by the supply device.

The touch fastener element is especially serviceable and mechanically durable if the stem parts and head parts are formed of plastic materials which are different from one another. In particular, the stem parts are formed from a thermoplastic, and the head parts are formed of acrylate material. The relatively hard acrylate material for the respective head part permits resistant hooking underneath for the loops of a corresponding touch fastener element so that a touch fastener structured in this way enables very high adhesive and peeling strength values.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure and which are schematic and not to scale.

DETAILED DESCRIPTION OF THE INVENTION

Figure 1:
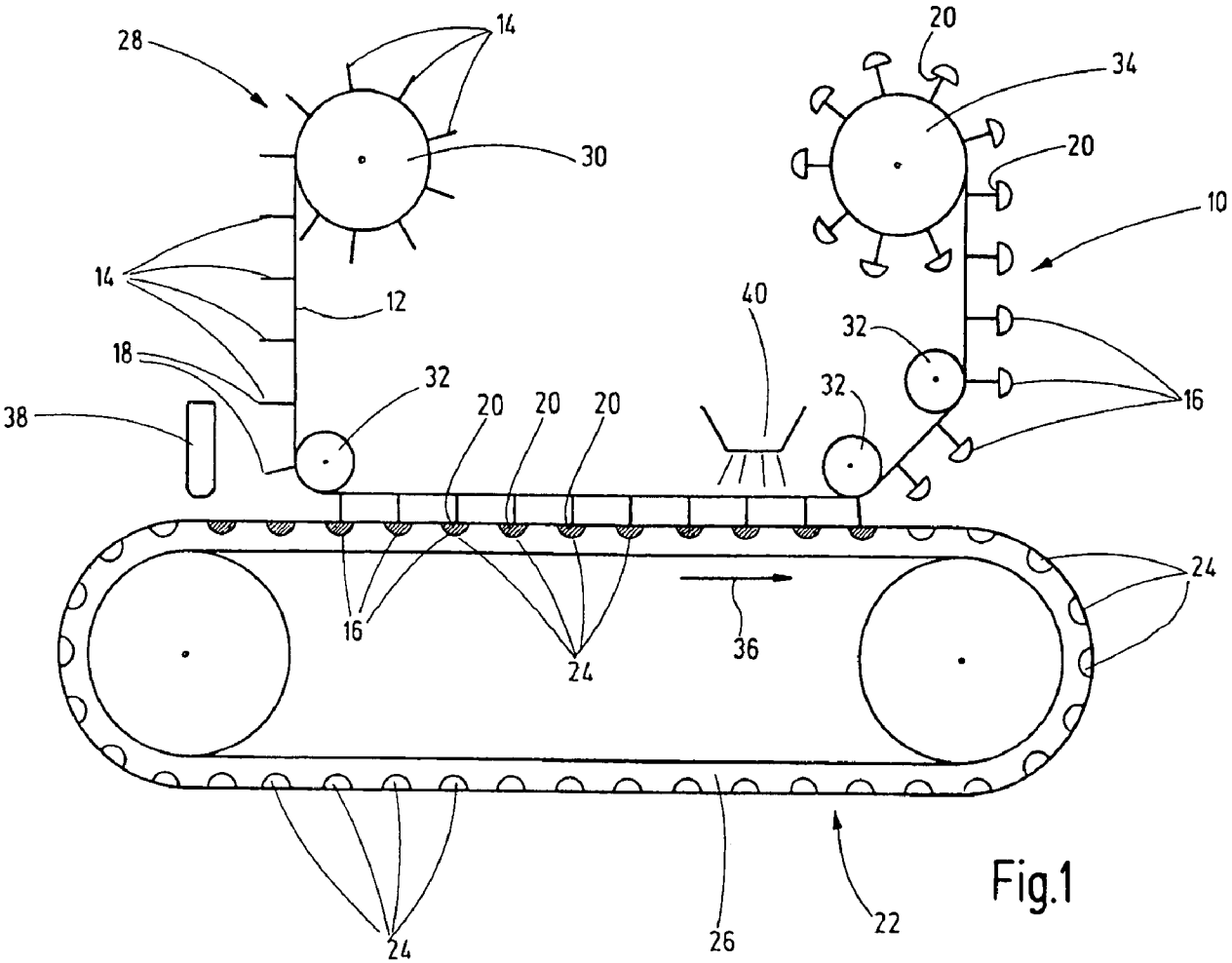
FIG. 1 is a side elevational view of a part of the production apparatus according to an exemplary embodiment of the invention.

The method according to the invention is detailed below using the production apparatus as shown in FIG. 1. The method according to the invention is used to produce a touch or touch-and-close fastener element 10. A belt-like backing part 12 is connected to a plurality of projecting stem parts 14 with individual head parts 16 such that at least for some of these stem parts 14 their free ends 18 come into contiguous or embedded contact with the contact side 20 of the respective head part 16. When using the method according to the invention, the actual process of connecting the stem parts 14 to the respective head parts 16, the head parts are still at least in the partially liquid or partially plasticized state. The head parts 16 are completely cured only after the connection. The free ends 18 of the stem parts 14 touch the still at least partially liquid contact sides 20 of the head parts 16 or preferably are embedded in the material of the head part to be able to ensure the connection in the subsequently cured state of the head part 16.

For molding the individual head parts 16, a molding tool 22 has a plurality of individual mold recesses 24 corresponding to the respective head geometry in terms of its configuration. The mold recesses 24 are a component of a molding belt 26 revolving in the manner of a transport belt. The mold recesses 24 of the upper strand are filled with plastic material. The lower strand guides essentially the empty mold recesses 24. The mold recesses 24 are in turn repeatedly present in a regular or irregular distribution in the transverse and longitudinal direction of the molding belt 22.

A supply device 28 supplies the already finished or preformed backing part 12 with the stem parts 14 whose free ends 18 can be inserted into the mold recesses 24 by the supply device 28. For this purpose, the supply device 28 has a type of storage roll 30 from which the stem part-fastener material can be unwound. By corresponding deflection rolls 32 the belt material can be supplied to the molding tool 22. The complete touch fastener product can be taken up on the end onto a transport roll 34 for further transport. For the sake of simpler depiction, individual transport and guide devices have been omitted. Likewise the heating and cooling devices for the production apparatus are not shown. The transport direction of the molding tool 22 and the supply device 28 is indicated with an arrow 36.

As FIG. 1 further shows, the mold recesses 24 are open to the outside. They are freely accessible from there, for filling the mold recesses 24 of the molding tool 22. A filling device 38 is used which, without being specified in detail, can be a conventional extruder application device. Preferably, filling device 38 constitutes a droplet application apparatus that does not completely fill the mold recesses 24 as far as the free edge with plastic material without the mold recesses 24 overflowing. The filling device 38 can also be made as a doctor device for the plastic material with excess plastic material being removable from the top of the belt by a doctor blade device (not shown).

To produce the fixed connection between the stem parts 14 and the head parts 16, in turn a curing device 40 (not detailed) is used and is located preferably at the end of the connecting process. Specifically, curing device 40 is at a short distance in front of the point before, viewed in the direction of the arrow 36, the finished touch fastener element is removed from the molding tool 22 and carried away in the direction of the transport roll 34. Depending on the plastic material used, the curing device 40 can be a conventional heat source, but also can be an UV emitter and the like. If acrylate material is used for the head parts 16, the curing device 40 is preferably a UV emission source.

Figure 2:
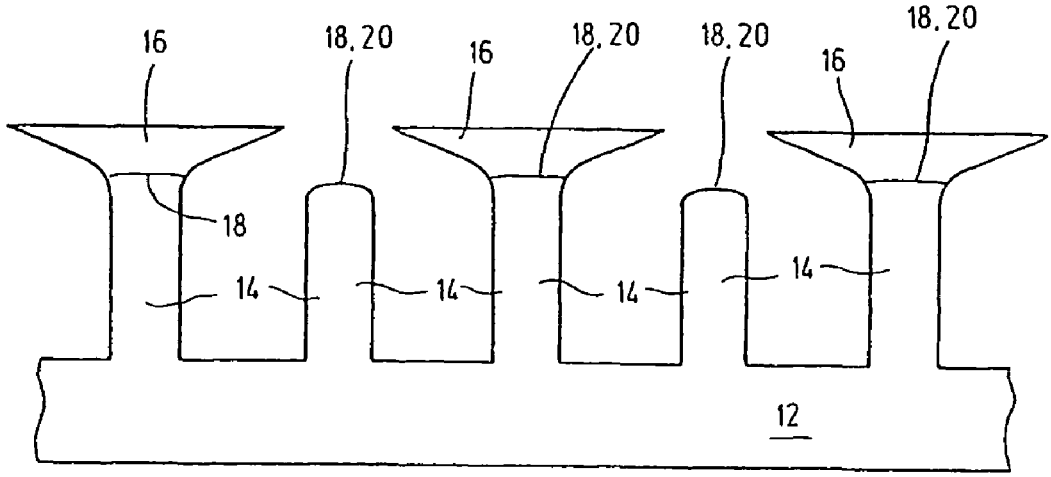
FIG. 2 is a side elevational view of a touch fastener element which can be produced, according to one embodiment of the invention.
Figure 3:
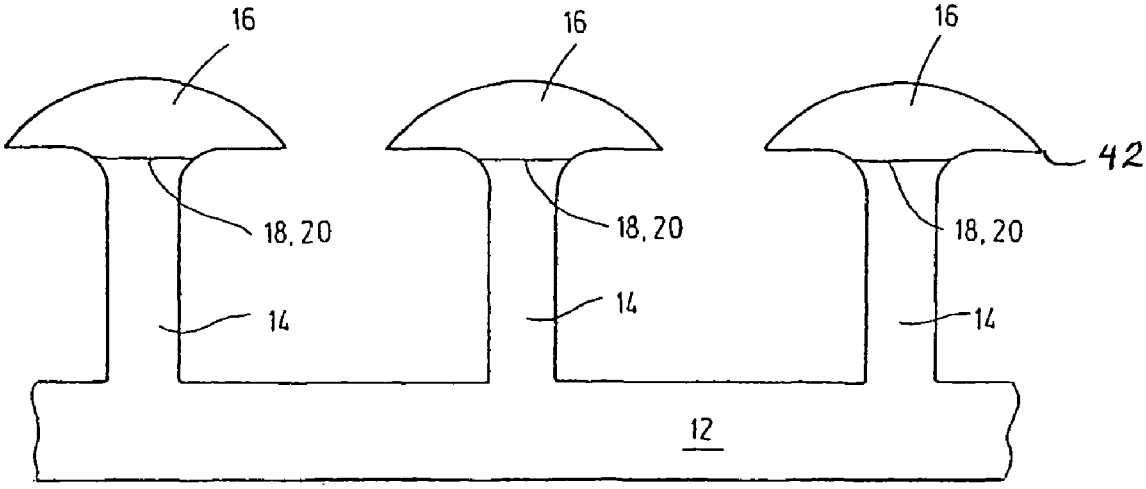
FIG. 3 is a side elevational view of a touch faster element which can be produced according to another embodiment of the invention.

Touch fastener elements produced according to the illustrated method using the described apparatus, are shown enlarged in FIGS. 2 and 3. The head parts 16 as shown in FIG. 2 are made essentially flat toward their free end side. This shape allows them to be made very narrow-lipped or thin-lipped relative to their surrounding edge, in contrast to the fastener solution as shown in FIG. 3, in which the top of the illustrated head part 16 is convexly curved so that this head part 16 toward the enclosing edge 42 extends with a thicker wall than the above described solution as shown in FIG. 2. It is common to both solutions that the head part 16 is formed of acrylate material, while the stem part consists preferably of a thermoplastic material, in particular of polyamide, polypropylene or polyethylene. Other material combinations are possible here.

It is surprising to one with average skill in the art in the field of fastener technology that for mushroom-head fastener systems any head parts 16 can be connected to any stem part material 14 in this way to be able to offer functional touch fasteners in a wide range of applications. As FIG. 2 in particular shows, not all stem parts 14 need be provided with a head part 16. In special applications it would also be possible to provide two and more stem parts 14 with only one head part 16 on the end side (not shown). Furthermore it would be possible, depending on the formation of the mold recesses 24, to devise fastener systems, for example, combining the head geometries of the fastener elements of FIGS. 2 and 3 according to predefinable patterns. Otherwise it has been shown that with the method according to the invention very smooth and hard head parts 16 can be obtained. This formation protects the fastener as a whole and leads to very long-lived touch fastener element systems.

Depending on the depth of the mold recesses 24 of the molding tool 22 used, different lengths for the stem parts 14 can also optionally be implemented so that then the head parts 16 end at different level heights relative to the belt-like backing part 12. The backing part 12 itself can be a multiextrusion layer arrangement or can have be film-like and elastically stretchable. The head parts 16 viewed from overhead can form spherical shell bodies which are smooth to the outside. Implementations in polygonal form, in particular in a hexagonal shape, are also possible. By using acrylate material for the head parts 16 they also form a type of edge protection toward their surrounding edge 42. This structure in turn benefits the service life of the overall fastener.

While one embodiment has been chosen to illustrate the invention, it will be understood by those skilled in the art that various changes and modifications can be made therein without departing from the scope of the invention as defined in the appended claims.

What is claimed is:

1. A method for producing a touch-and-close fastener, comprising the steps of:

providing a preformed backing part with a plurality of stem parts extending from the backing part and with the stem parts having free ends remote from the backing part;

placing head part material in a plurality of individual mold recesses having geometries corresponding to geometries of heads to be connected to the free ends of the stem parts;

moving the free ends of the stem parts up to and inserting the free ends of the stem parts into the mold recesses such that the free ends of the stem parts one of touch at least partially liquid contact sides of the head part material and are embedded in the head part material that is practically liquid; and curing the head part material while the stem parts one of touch and are embedded in the head part material to provide head parts on the stem parts.

2. A method according to claim 1 wherein:

the head part material comprises a plastic material different from material of the stem parts.

3. A method according to claim 1 wherein:

the stem parts are embedded in the head part material.

4. An apparatus for producing a touch-and-close closure device, comprising:

a molding tool with a plurality of mold recesses receiving head part material, said mold recesses having geometries corresponding to geometries for head parts for the adhesive closure device, said molding tool having a revolving molding belt containing said mold recesses, said mold recesses being freely accessible from a side of said molding belt; and a supply device providing a finished backing part and plurality of finished stem parts extending from said backing part with said stem parts having free ends remote from said backing part, said supply device inserting said free ends of said stem parts into said mold recesses so as to one of touch at least partially liquid contact sides of said head part material and embed in said head part material until curing of the head part material to provide said head parts on said stem parts.

5. An apparatus according to claim 4 wherein:

a filler is mounted adjacent said molding belt to fill said mold recesses with said head part material; and a curer is mounted adjacent said molding belt and downstream of said filler to secure said head parts to said stem parts.

* * * * *